US011633958B2

(12) United States Patent
Kemma et al.

(10) Patent No.: US 11,633,958 B2
(45) Date of Patent: Apr. 25, 2023

(54) LIQUID DISCHARGE APPARATUS

(71) Applicant: Ricoh Company, Ltd., Tokyo (JP)

(72) Inventors: Tsuguyori Kemma, Kanagawa (JP); Kazuyoshi Matsumoto, Tokyo (JP); Satoshi Ueno, Tokyo (JP); Yuzo Obata, Tokyo (JP); Kazuyoshi Kondo, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 195 days.

(21) Appl. No.: 17/157,009

(22) Filed: Jan. 25, 2021

(65) Prior Publication Data

US 2021/0237467 A1 Aug. 5, 2021

(30) Foreign Application Priority Data

Feb. 5, 2020 (JP) ..... JP2020-018079
Nov. 4, 2020 (JP) ..... JP2020-184360

(51) Int. Cl.
*B41J 2/215* (2006.01)

(52) U.S. Cl.
CPC ..... *B41J 2/215* (2013.01)

(58) Field of Classification Search
CPC .. B41J 2/1714; B41J 2/17563; B41J 11/0022; B41J 29/377; B41J 19/207
See application file for complete search history.

(56) References Cited

U.S. PATENT DOCUMENTS 5,428,384 A * 6/1995 Richtsmeier ..... B41J 2/1714 347/102
5,774,141 A * 6/1998 Cooper ..... B41J 2/1714 347/93
6,224,203 B1 * 5/2001 Wotton ..... B41J 11/0085 347/101
6,328,442 B1 * 12/2001 Brinkly ..... B41J 29/10 347/104
6,390,618 B1 * 5/2002 Wotton ..... B41J 11/00216 347/102
8,474,968 B2 * 7/2013 Yamaguchi ..... B41J 11/0022 347/17
9,315,037 B2 * 4/2016 Gasso Puchal ..... B41J 2/1714
9,981,474 B2 * 5/2018 Goto ..... B41J 3/4078
2009/0174749 A1 7/2009 Kemma
2010/0026758 A1 2/2010 Tanaka et al.
2010/0061745 A1 3/2010 Ito et al.
(Continued)

FOREIGN PATENT DOCUMENTS

JP 2002-355993 12/2002
JP 2004-114517 4/2004
(Continued)

*Primary Examiner* — John Zimmermann
(74) *Attorney, Agent, or Firm* — Xsensus LLP

(57) ABSTRACT

A liquid discharge apparatus includes a body and a carriage disposed inside the body. A head is mounted on the carriage. The head discharges ink onto a recording medium and generates ink mist. An ink mist collector includes a fan that generates an air current that circulates in an air flow direction inside the body. A filter collects the ink mist generated by the head. At least one duct adjusts the air flow direction. An encoder is mounted on the carriage. The encoder is disposed downstream from the fan and disposed upstream from the head in the air flow direction.

14 Claims, 14 Drawing Sheets

(56) References Cited

U.S. PATENT DOCUMENTS

| | | | | |
|---|---|---|---|---|
| 2010/0067938 | A1 | 3/2010 | Kemma et al. | |
| 2010/0207990 | A1 | 8/2010 | Ito et al. | |
| 2011/0109693 | A1* | 5/2011 | Ohnishi | B41J 29/02 347/34 |
| 2011/0273511 | A1 | 11/2011 | Yanase et al. | |
| 2011/0279499 | A1 | 11/2011 | Kemma et al. | |
| 2011/0310172 | A1* | 12/2011 | Miyata | B41J 2/1714 347/34 |
| 2012/0293583 | A1 | 11/2012 | Kemma et al. | |
| 2012/0320127 | A1 | 12/2012 | Kikura et al. | |
| 2013/0113861 | A1 | 5/2013 | Kikura et al. | |
| 2013/0113862 | A1 | 5/2013 | Kemma et al. | |
| 2013/0257986 | A1 | 10/2013 | Yanase et al. | |
| 2016/0031239 | A1 | 2/2016 | Yanase et al. | |
| 2018/0217536 | A1 | 8/2018 | Obata et al. | |
| 2018/0313033 | A1 | 11/2018 | Yanase et al. | |
| 2019/0009586 | A1 | 1/2019 | Yanase et al. | |
| 2019/0111710 | A1 | 4/2019 | Enomoto et al. | |
| 2020/0032452 | A1 | 1/2020 | Kemma | |

FOREIGN PATENT DOCUMENTS

| | | |
|---|---|---|
| JP | 2004-202803 | 7/2004 |
| JP | 2005-161758 | 6/2005 |
| JP | 2005-219437 | 8/2005 |
| JP | 2007-216639 | 8/2007 |
| JP | 2012-045861 | 3/2012 |

* cited by examiner

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2020-018079, filed on Feb. 5, 2020, and 2020-184360, filed on Nov. 4, 2020, in the Japan Patent Office, the entire disclosure of each of which is hereby incorporated by reference herein.

BACKGROUND

Technical Field

Exemplary aspects of the present disclosure relate to a liquid discharge apparatus.

Discussion of the Background Art

Related-art liquid discharge apparatuses such as an inkjet image forming apparatus include a head that discharges main drops to form an image on a recording medium. In addition to the main drops, ink mist that is smaller than a main drop may generate inside the liquid discharge apparatus, degrading quality of the image and staining an interior of the liquid discharge apparatus.

SUMMARY

This specification describes below an improved liquid discharge apparatus. In one embodiment, the liquid discharge apparatus includes a body and a carriage disposed inside the body. A head is mounted on the carriage. The head discharges ink onto a recording medium and generates ink mist. An ink mist collector includes a fan that generates an air current that circulates in an air flow direction inside the body. A filter collects the ink mist generated by the head. At least one duct adjusts the air flow direction. An encoder is mounted on the carriage. The encoder is disposed downstream from the fan and disposed upstream from the head in the air flow direction.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
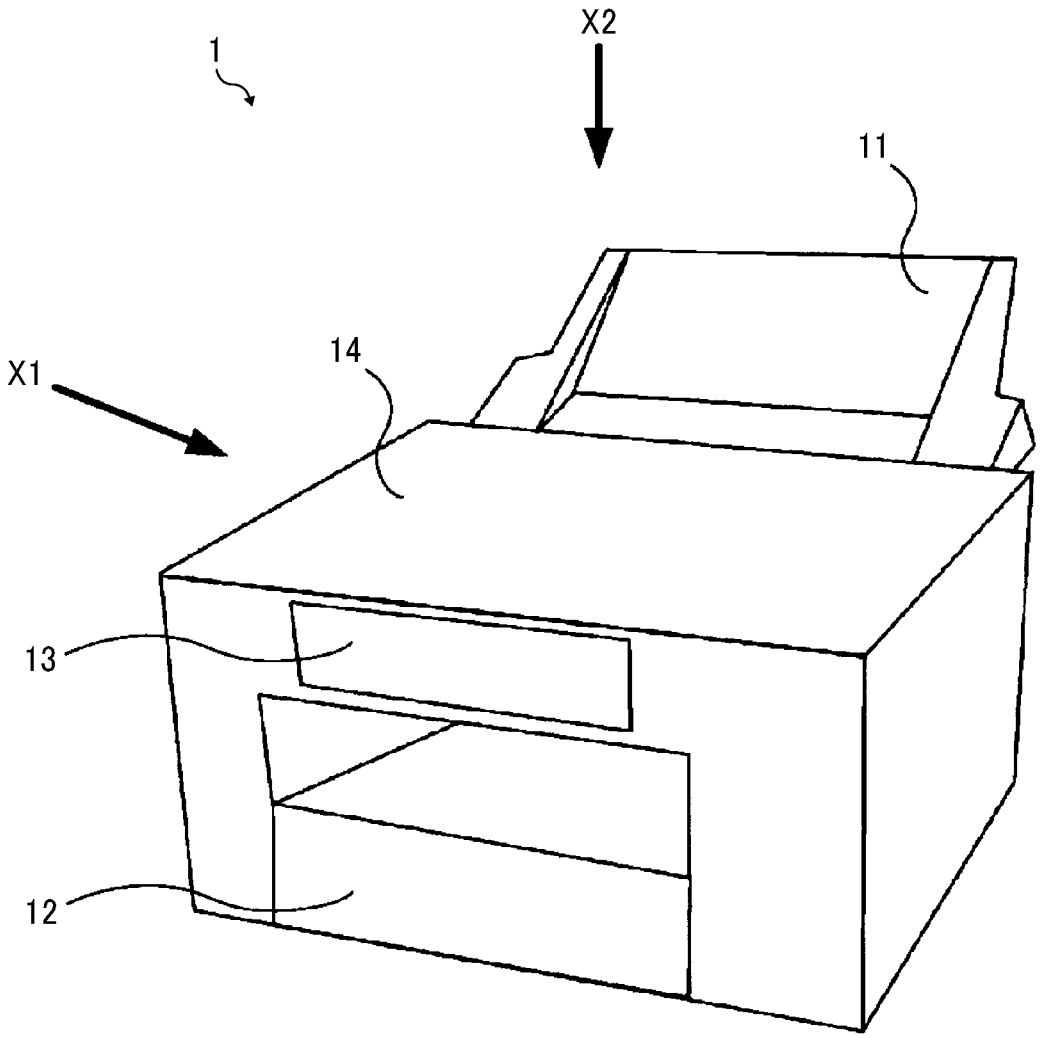
FIG. 1 is an external perspective view of a liquid discharge apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a liquid discharge apparatus according to embodiments of the present disclosure. The technology of the present disclosure is not limited to the embodiments described below and may be modified within scopes suggested by those skilled in art, such as other embodiments, addition, modification, and deletion. The technology of the present disclosure encompasses various embodiments that achieve operations and advantages of the technology of the present disclosure.

A description is provided of a construction of a liquid discharge apparatus 1 according to an embodiment of the present disclosure, that discharges liquid.

FIG. 1 is an external perspective view of the liquid discharge apparatus 1 as an example of a desk top liquid discharge apparatus.

Figure 2:
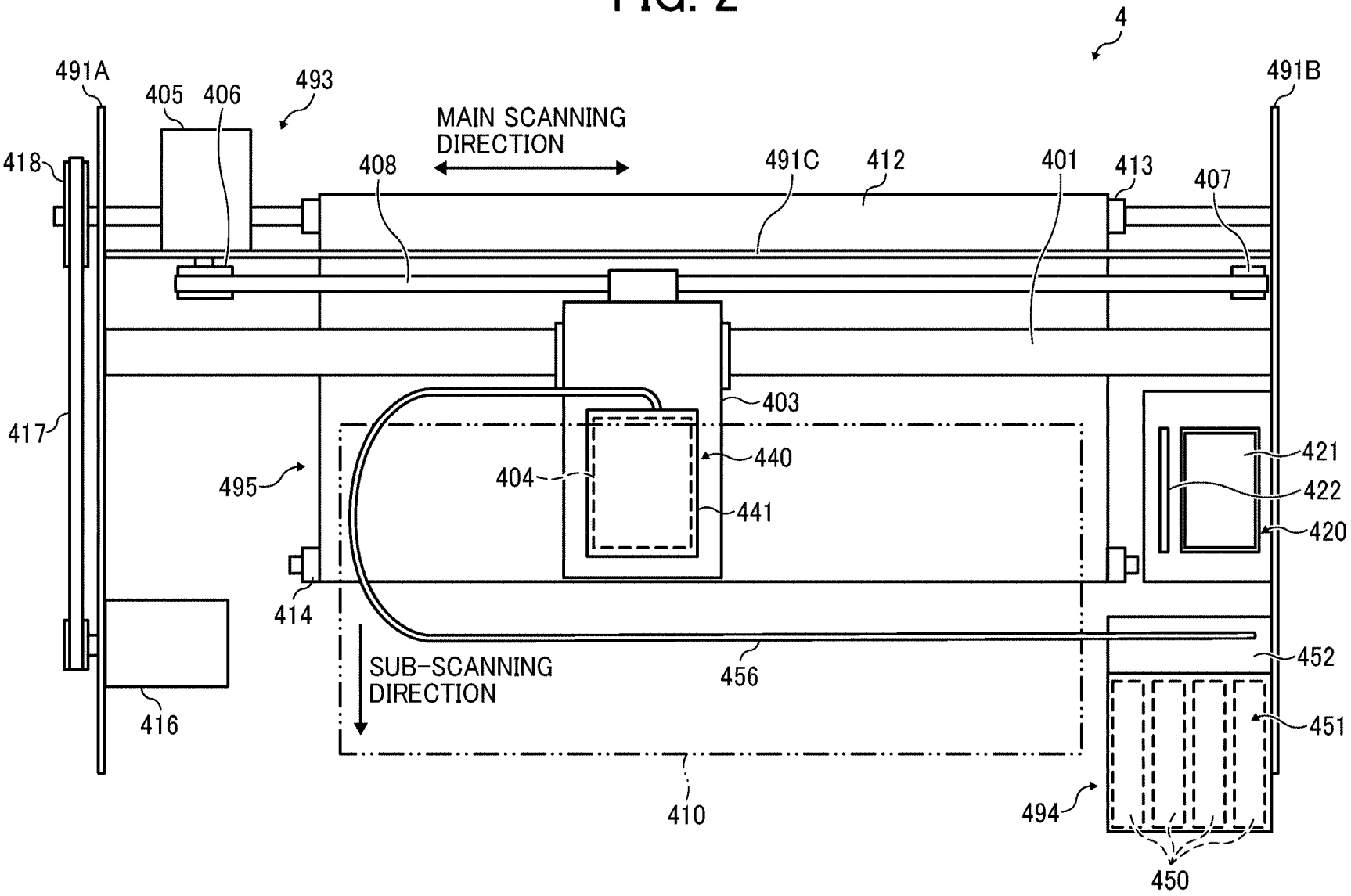
FIG. 2 is a top view of an inkjet printer as one example of the liquid discharge apparatus depicted in FIG. 1, illustrating a main section of the inkjet printer.

As illustrated in FIG. 1, the liquid discharge apparatus 1 includes a body 14, a control panel 13, a sheet tray 12, and a bypass feeder 11. The control panel 13 is placed on a part of the body 14, that is readily accessible by a user. The sheet tray 12 (e.g., a paper tray) and the bypass feeder 11 (e.g., a bypass tray) load recording media 410 depicted in FIG. 2 to be supplied to an inside of the body 14. FIG. 2 illustrates a liquid discharge apparatus 4 that is equivalent to the liquid discharge apparatus 1 depicted in FIG. 1.

As illustrated in FIG. 2, an inkjet, liquid discharge unit 440 is disposed inside the body 14. The liquid discharge unit 440 forms an image on a recording medium 410 supplied from the bypass feeder 11 or the sheet tray 12.

Figure 3:
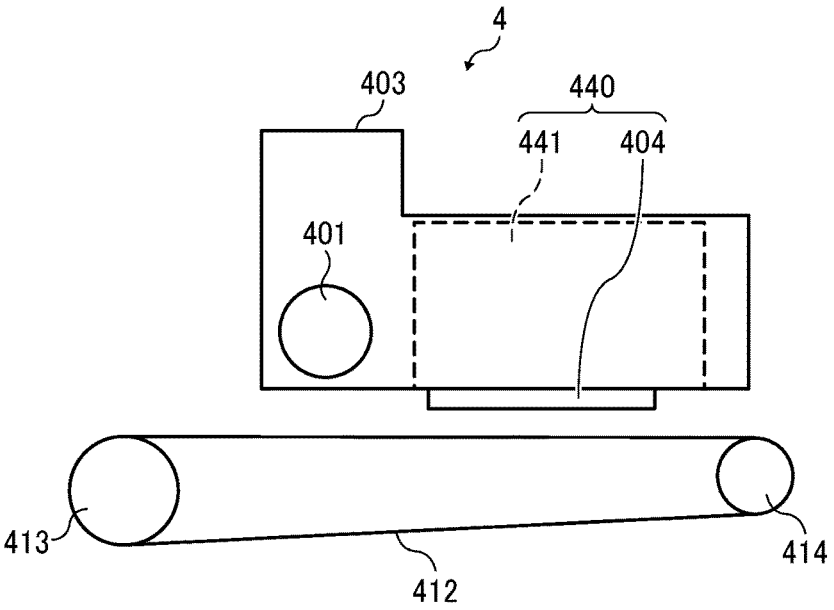
FIG. 3 is a side view of the inkjet printer depicted in FIG. 2, seen from a right side thereof, illustrating the main section of the inkjet printer, that includes a liquid discharge unit.

FIG. 2 is a top view of the liquid discharge apparatus 4, that is equivalent to the liquid discharge apparatus 1, seen in a direction X2 in FIG. 1, illustrating a main section of the liquid discharge apparatus 4 seen from above. FIG. 3 is a side view of the liquid discharge apparatus 4 seen in a direction X1 in FIG. 1, illustrating the main section of the liquid discharge apparatus 4 seen from a right side thereof.

The liquid discharge apparatus 4 is a serial type liquid discharge apparatus. A main scanning direction moving mechanism 493 moves a carriage 403 reciprocatingly in a main scanning direction. The main scanning direction moving mechanism 493 includes a guide 401, a main scanning motor 405, and a timing belt 408. The guide 401 bridges side plates 491A and 491B, that is, a left side plate and a right side plate, respectively, in FIG. 2. The guide 401 movably supports the carriage 403. The main scanning motor 405 moves the carriage 403 reciprocatingly in the main scanning direction through the timing belt 408 looped over a driving pulley 406 and a driven pulley 407.

The carriage 403 is installed with the liquid discharge unit 440 into which a liquid discharge head 404 and a head tank 441 according to this embodiment are combined. For example, the liquid discharge unit 440 includes the liquid discharge head 404 that discharges liquid in yellow (Y), cyan (C), magenta (M), and black (K), respectively. The liquid discharge head 404 mounts a plurality of nozzles aligned in a row in a sub-scanning direction perpendicular to the main scanning direction. The plurality of nozzles is mounted on the liquid discharge head 404 and directed downward to discharge liquid downward.

A supply mechanism 494 supplies liquid stored outside the liquid discharge head 404 to the liquid discharge head 404. The supply mechanism 494 supplies liquid stored in liquid cartridges 450 to the head tank 441.

The supply mechanism 494 includes a cartridge holder 451, a tube 456, and a liquid feeding unit 452. The cartridge holder 451 serves as a loading portion that loads the liquid cartridges 450. The liquid feeding unit 452 includes a liquid feeding pump. The liquid cartridges 450 are removably mounted on the cartridge holder 451. The liquid feeding unit 452 feeds liquid from the liquid cartridge 450 to the head tank 441 through the tube 456.

The liquid discharge apparatus 4 further includes a conveying mechanism 495 that conveys a recording medium 410. The conveying mechanism 495 includes a conveying belt 412 serving as a conveyor and a sub-scanning motor 416 that drives the conveying belt 412.

The conveying belt 412 attracts the recording medium 410 and conveys the recording medium 410 to an opposed position where the recording medium 410 is disposed opposite the liquid discharge head 404. The conveying belt 412 is an endless belt looped over a conveying roller 413 and a tension roller 414. The conveying belt 412 attracts the recording medium 410 by electrostatic attraction, air suction, or the like.

As the sub-scanning motor 416 drives and rotates the conveying roller 413 through a timing belt 417 and a timing pulley 418, the conveying belt 412 rotates in the sub-scanning direction.

A maintenance-restoration mechanism 420 is disposed opposite one lateral end of each of the carriage 403 and the conveying belt 412 in the main scanning direction. The maintenance-restoration mechanism 420 performs maintenance and restoration of the liquid discharge head 404.

For example, the maintenance-restoration mechanism 420 includes a cap 421 and a wiper 422. The cap 421 caps a nozzle face of the liquid discharge head 404, that mounts the nozzles. The wiper 422 wipes the nozzle face of the liquid discharge head 404.

The main scanning direction moving mechanism 493, the supply mechanism 494, the maintenance-restoration mechanism 420, and the conveying mechanism 495 are mounted on a housing constructed of the side plates 491A and 491B, a rear plate 491C, and the like.

With the construction of the liquid discharge apparatus 4 as described above, while the conveying belt 412 attracts the recording medium 410 supplied onto the conveying belt 412, as the conveying belt 412 rotates, the conveying belt 412 conveys the recording medium 410 in the sub-scanning direction.

While the carriage 403 moves in the main scanning direction, as the liquid discharge head 404 is driven according to an image signal, the liquid discharge head 404 discharges liquid onto the recording medium 410 that is halted, thus forming an image on the recording medium 410.

As described above, the liquid discharge apparatus 4 incorporates the liquid discharge head 404 according to this embodiment, forming a high quality image stably.

Figure 4:
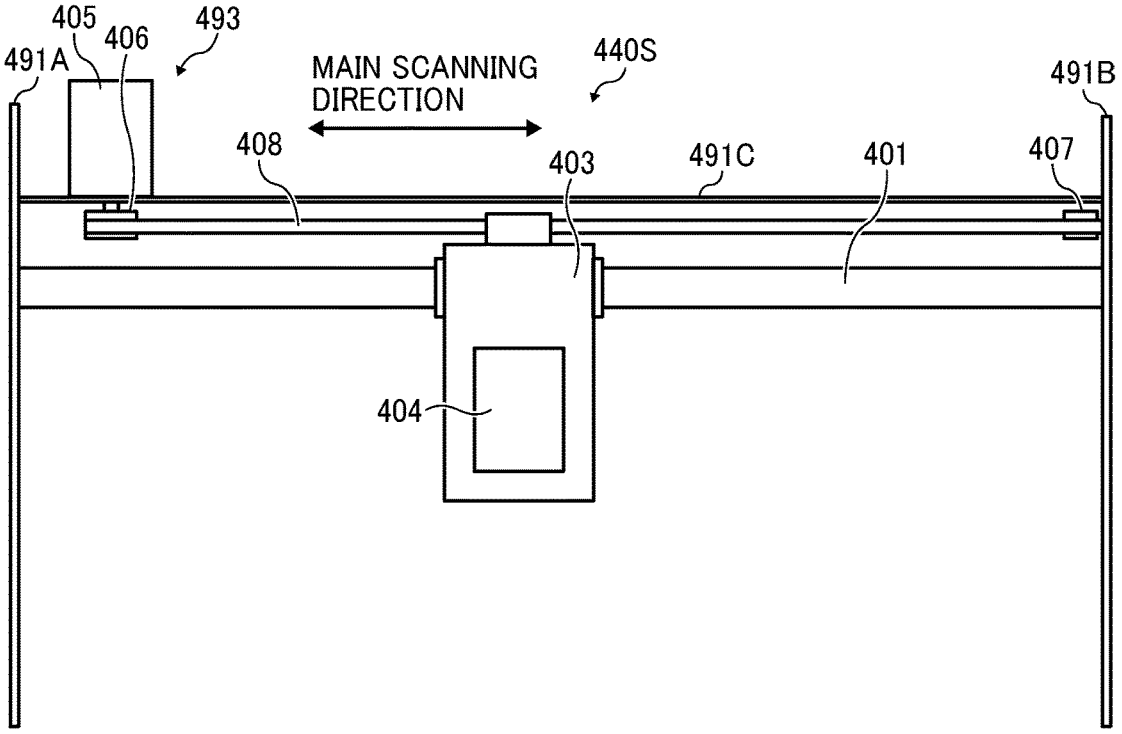
FIG. 4 is a plan view of a liquid discharge unit according to a first modification example of the liquid discharge unit depicted in FIG. 3, illustrating the main section of the inkjet printer.

Referring to FIG. 4, a description is provided of a construction of a liquid discharge unit 440S as another example.

FIG. 4 is a plan view of a main section of the liquid discharge unit 440S according to a first modification example of the liquid discharge unit 440.

The liquid discharge unit 440S includes, among components constructing the liquid discharge apparatus 4, the housing constructed of the side plates 491A and 491B and the rear plate 491C, the main scanning direction moving mechanism 493, the carriage 403, and the liquid discharge head 404.

Alternatively, at least one of the maintenance-restoration mechanism 420 and the supply mechanism 494 described above may be attached to the side plate 491B, for example, of the liquid discharge unit 440S.

Figure 5:
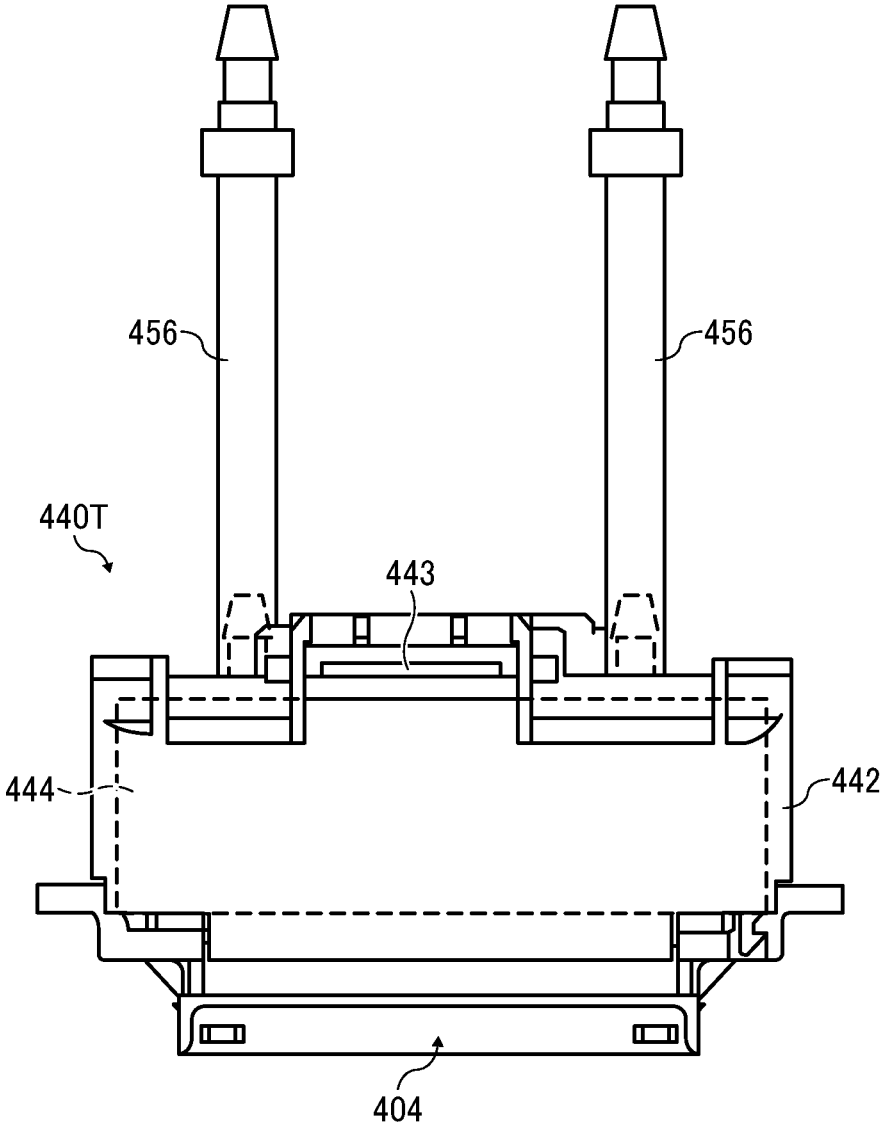
FIG. 5 is a front view of a liquid discharge unit according to a second modification example of the liquid discharge unit depicted in FIG. 3.

Referring to FIG. 5, a description is provided of a construction of a liquid discharge unit 440T as yet another example.

FIG. 5 is a front view of the liquid discharge unit 440T according to a second modification example of the liquid discharge unit 440.

The liquid discharge unit 440T includes the liquid discharge head 404 attached with a channel part 444 and the tubes 456 coupled to the channel part 444.

The channel part 444 is disposed inside a cover 442. Alternatively, instead of the channel part 444, the liquid discharge unit 440T may incorporate the head tank 441. A connector 443 is disposed above the channel part 444 and is electrically connected to the liquid discharge head 404.

According to the embodiments of the present disclosure, a liquid discharge apparatus includes at least one of a liquid discharge head and a liquid discharge unit. The liquid discharge apparatus drives the liquid discharge head to discharge liquid. The liquid discharge apparatus includes an apparatus that discharges liquid into air or liquid in addition to an apparatus that discharges liquid onto an object to which the liquid adheres.

The liquid discharge apparatus may include means that feeds, conveys, or ejects the object to which the liquid adheres, a pretreatment apparatus, and a finisher.

For example, the liquid discharge apparatus is an image forming apparatus or a stereoscopic shaping apparatus. The image forming apparatus discharges ink onto a sheet to form an image on the sheet. The stereoscopic shaping apparatus (e.g., a three-dimensional shaping apparatus) discharges shaping liquid onto a powder layer produced by layering 5 powder to fabricate a stereoscopic object (e.g., a three-dimensional object).

The liquid discharge apparatus is not limited to an apparatus that visualizes a significant image such as a character and a figure with liquid discharged by the apparatus. For example, the liquid discharge apparatus also includes an apparatus that forms a pattern and the like that do not have meaning and an apparatus that fabricates a three-dimensional statue.

The object to which the liquid adheres denotes an object to which liquid adheres at least temporarily. For example, the liquid is adhered and fixed to the object or is adhered to and permeated into the object. Specifically, the object to which the liquid adheres includes recording media such as a sheet, recording paper, a recording sheet, film, and cloth, electronic components such as an electronic substrate and a piezoelectric element, and media such as a powder layer, an organ model, and an inspection cell. The object to which the liquid adheres includes various objects to which liquid adheres unless otherwise specified.

The object to which the liquid adheres is made of a material to which the liquid adheres at least temporarily, for example, paper, thread, fiber, cloth, leather, metal, plastic, glass, wood, ceramic, a building material such as wallpaper and a floor material, a textile for clothing, and the like.

The liquid includes ink, process liquid, a deoxyribonucleic acid (DNA) sample, a resist, a pattern material, a binding agent, modeling liquid, and a solution and dispersion liquid containing amino acid, protein, or calcium.

The liquid discharge apparatus is an apparatus in which the liquid discharge head and the object to which the liquid adheres move relative to each other. However, the liquid discharge apparatus may have other configurations. For example, the liquid discharge apparatus may be a serial type apparatus in which the liquid discharge head moves or a line type apparatus in which the liquid discharge head does not move.

Further, the liquid discharge apparatus may be a process liquid applicating apparatus that discharges process liquid onto a sheet to apply the process liquid onto a surface of the sheet to achieve an objective such as reforming the surface of the sheet or a jet granulator that jets composition liquid prepared by dispersing a raw material in a solution through a nozzle to granulate fine particles of the raw material.

The liquid discharge unit is a unit in which the liquid discharge head is combined with functional parts and a mechanism, that is, an aggregation of parts relating to discharge of liquid. For example, the liquid discharge unit includes a combination of the liquid discharge head with at least one of a head tank, a carriage, a supply mechanism, a maintenance-restoration mechanism, and a main scanning direction moving mechanism.

For example, the combination has a construction in which a first component (e.g., the liquid discharge head) and a second component (e.g., the functional parts and the mechanism) are secured to each other by fastening, adhesion, engagement, or the like, a construction in which the first component movably supports the second component, a construction in which the second component movably supports the first component, or the like. Alternatively, the first component and the second component may be removably attached to each other.

For example, the liquid discharge unit includes the liquid discharge head that is combined with the head tank, like the liquid discharge unit 440 depicted in FIG. 3. Alternatively, the liquid discharge unit may include the liquid discharge head that is coupled with the head tank through a tube or the like and thus combined with the head tank. A unit including a filter may be added and interposed between the head tank and the liquid discharge head of the liquid discharge unit.

The liquid discharge unit may include the liquid discharge head that is combined with the carriage.

The liquid discharge unit may include the liquid discharge head that is movably supported by a guide serving as a part of a scanning direction moving mechanism and thus combined with the scanning direction moving mechanism.

As illustrated in FIG. 4, the liquid discharge unit may include the liquid discharge head that is combined with the carriage and the main scanning direction moving mechanism.

The liquid discharge unit may have a configuration in which a cap serving as a part of the maintenance-restoration mechanism is secured to the carriage mounting the liquid discharge head, thus combining the liquid discharge head with the carriage and the maintenance-restoration mechanism.

As illustrated in FIG. 5, the liquid discharge unit may have a configuration in which the tube is coupled with the head tank or the liquid discharge head mounting a channel part and thus the liquid discharge head is combined with the supply mechanism.

The main scanning direction moving mechanism may also include the guide as a single component. The supply mechanism may also include the tube or a loading portion as a single component.

A pressure generator employed by the liquid discharge head is not limited. For example, the liquid discharge head employs a piezoelectric actuator (e.g., a laminated piezoelectric element) as described above in the embodiments. Alternatively, the liquid discharge head may employ a thermal actuator using a thermoelectric conversion element such as a heat generation resistor, an electrostatic actuator constructed of a vibrating plate and a counter electrode, or the like.

The terms used in the present disclosure, that is, image formation, recording, printing, imaging, shaping, fabricating, and the like, are synonyms.

Figure 6:
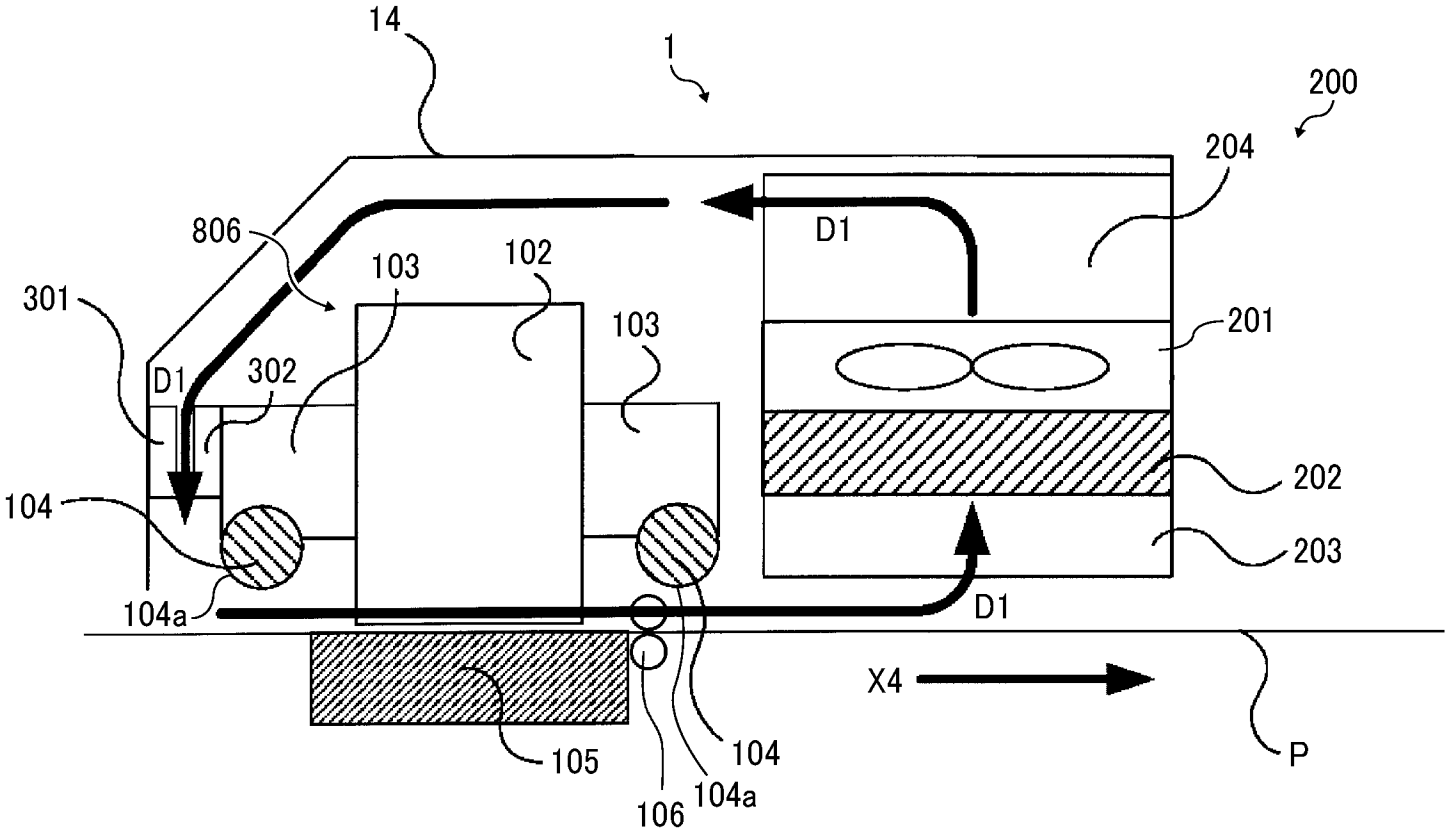
FIG. 6 is a side view of the liquid discharge apparatus according to a first embodiment of the present disclosure depicted in FIG. 1, seen from a right side thereof, illustrating a main section of the liquid discharge apparatus.
Figure 7:
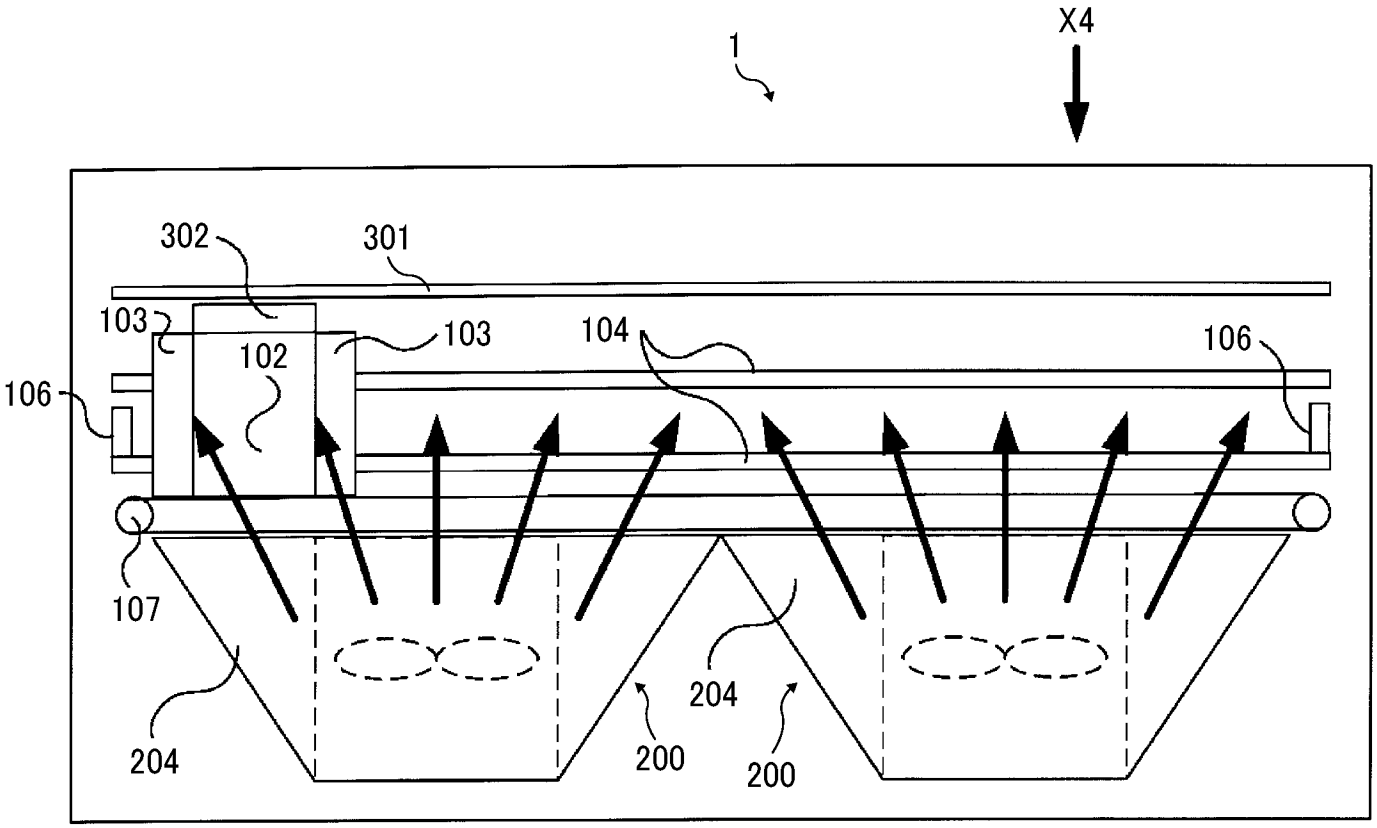
FIG. 7 is a top view of the liquid discharge apparatus according to the first embodiment depicted in FIG. 6, illustrating the main section of the liquid discharge apparatus.

FIG. 6 is a side view of the liquid discharge apparatus 1 seen in the direction X1 in FIG. 1, illustrating a main section of the liquid discharge apparatus 1 seen from a right side thereof. FIG. 7 is a top view of the liquid discharge apparatus 1 seen in the direction X2 in FIG. 1, illustrating the main section of the liquid discharge apparatus 1 seen from above.

As illustrated in FIGS. 6 and 7, the liquid discharge apparatus 1 includes a printing device 806 and an ink mist collector 200 that are disposed inside the body 14.

The printing device 806 includes a head 102, a carriage 103, guide rods 104, a platen 105, an encoder strip 301, an encoder 302, a conveyor 106, and a carriage driver 107.

The head 102 includes an ink chamber and an ink outlet. The ink chamber is attached with piezoelectric elements that are shaped in comb teeth and disposed opposite each other. The ink outlet is disposed atop the ink chamber. An ink tank supplies ink to the ink chamber. As a voltage is applied to the piezoelectric elements, the ink chamber enlarges, sucking ink. As a voltage is applied to the piezoelectric elements in an opposite direction, the ink chamber shrinks, discharging ink through the ink outlet.

The head 102 discharges a main drop used for image formation and simultaneously generates ink mist having a particle diameter smaller than that of the main drop. The ink mist may degrade quality of an image and may stain an interior of the liquid discharge apparatus 1.

A description is provided of a construction of a comparative liquid discharge apparatus.

In order to prevent ink mist from degrading quality of an image and staining an interior of the comparative liquid discharge apparatus, the comparative liquid discharge apparatus includes a fan and a duct. The fan generates an air current that flows in a conveyance direction of a recording medium or an opposite direction opposite the conveyance direction. The duct collects the air current. The fan and the duct are mounted on a carriage.

However, the fan and the duct mounted on the carriage may increase the weight of the carriage. Accordingly, a timing belt and a motor that drive the carriage may have an increased strength, increasing manufacturing costs.

Referring back to FIGS. 6 and 7 illustrating the liquid discharge apparatus 1 according to the embodiment, the carriage 103 supports the head 102. The carriage 103 is slidably placed on the two guide rods 104 that are parallel to each other and extended in the main scanning direction. The carriage driver 107 moves the carriage 103 reciprocatingly in the main scanning direction.

The carriage driver 107 includes a driving roller, a driven roller, and an endless, timing belt that is looped over the driving roller and the driven roller and extended in the main scanning direction. The carriage 103 is secured to the timing belt.

As illustrated in FIG. 6, the platen 105 is disposed opposite the head 102 via a recording medium conveyance path, through which a recording medium P is conveyed, along a motion span of the head 102.

The encoder strip 301 is disposed on an inner face of the body 14 and extended in the main scanning direction.

The encoder 302 is mounted on the carriage 103 and disposed opposite the encoder strip 301. The encoder 302 optically scans the encoder strip 301 and converts scanned data into an electric signal. The encoder 302 outputs the electric signal to a controller 801 depicted in FIG. 14. The controller 801 determines a speed at which the carriage 103 moves, a position of the carriage 103, and the like based on an output from the encoder 302.

As illustrated in FIGS. 6 and 7, the conveyor 106 includes a pair of conveying rollers. While the conveying rollers nip the recording medium P, the conveying rollers convey the recording medium P supplied from the sheet tray 12 or the bypass feeder 11 in a recording medium conveyance direction X4, that is, the sub-scanning direction perpendicular to the main scanning direction.

Figure 14:
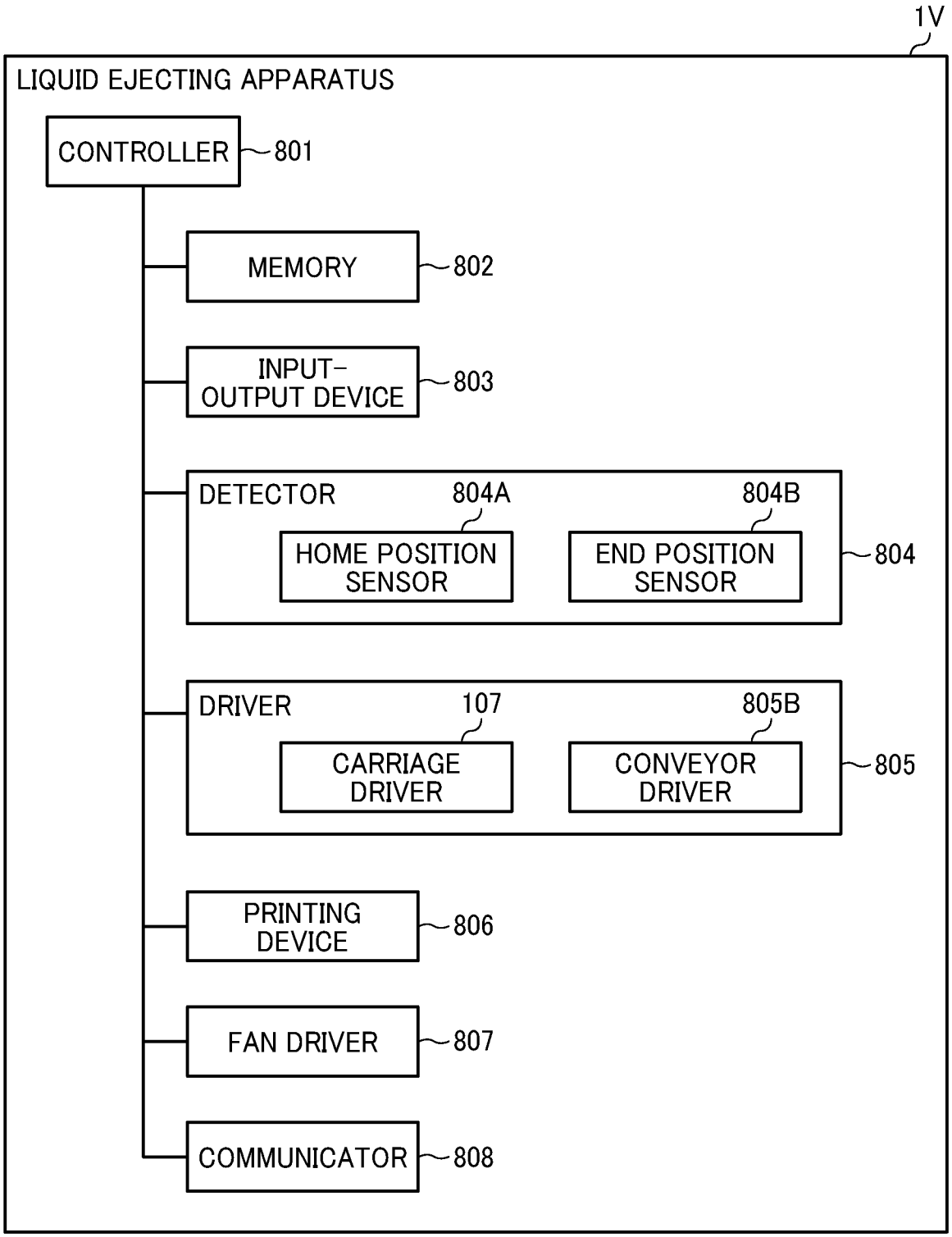
FIG. 14 is a block diagram of a liquid discharge apparatus according to a fourth embodiment of the present disclosure, illustrating a construction thereof.

A home position sensor 804A depicted in FIG. 14 is disposed in proximity to one lateral end of the guide rods 104 in the main scanning direction. An end position sensor 804B depicted in FIG. 14 is disposed in proximity to another lateral end of the guide rods 104 in the main scanning direction.

As the controller 801 receives a print instruction from an external device, the controller 801 controls the carriage driver 107 to move the carriage 103 to a home position where the home position sensor 804A detects the carriage 103. While the controller 801 drives the head 102, the controller 801 controls the carriage driver 107 to drive and move the carriage 103 in the main scanning direction, thus performing image formation in a single line.

When the end position sensor 804B detects the carriage 103, the controller 801 interrupts driving the head 102 and the carriage driver 107 and controls a conveyor driver 805B to drive the conveyor 106, thus conveying the recording medium P in the sub-scanning direction for a single line.

The controller 801 further repeats an image forming operation and a recording medium conveying operation, thus forming an image on a surface of the recording medium P.

A description is provided of a construction of the ink mist collector 200.

A description is provided of a construction of the liquid discharge apparatus 1 according to a first embodiment of the present disclosure that incorporates the ink mist collector 200.

As illustrated in FIG. 6, the ink mist collector 200 is disposed opposite the encoder strip 301 via the carriage 103. The ink mist collector 200 is separated from the carriage 103 and secured to the inner face of the body 14. A plurality of ink mist collectors 200 may be disposed in the main scanning direction along a motion span of the carriage 103.

The ink mist collector 200 includes a suction duct 203, a filter 202 serving as an ink mist absorber, a fan 201, and an exhaust duct 204 that are stacked in this order upward in FIG. 6. The fan 201 is disposed downstream from the filter 202 in an air flow direction D1. Accordingly, the filter 202 catches ink mist, preventing the ink mist from staining the fan 201.

As illustrated in FIG. 6 with the air flow direction D1, while air containing ink mist sucked through the suction duct 203 passes through the filter 202, the filter 202 catches the ink mist. The fan 201 sucks clean air not containing the ink mist. The clean air further travels through the exhaust duct 204 and circulates inside the body 14, thus being supplied to the inside of the liquid discharge apparatus 1.

The clean air travels along an opposite face of the head 102, that is opposite an ink outlet of the head 102. The clean air passes through a gap between the encoder strip 301 and the encoder 302 and travels over a slide face 104*a* of the guide rod 104, reaching the head 102.

Wind pressure of the clean air is sufficiently small with respect to a discharging speed of a main drop discharged from the head 102. Accordingly, flowing of the clean air does not degrade quality of an image formed on a recording medium P.

The wind pressure of the clean air is great enough to collect the ink mist. Accordingly, the suction duct 203 collects the ink mist.

Figure 8:
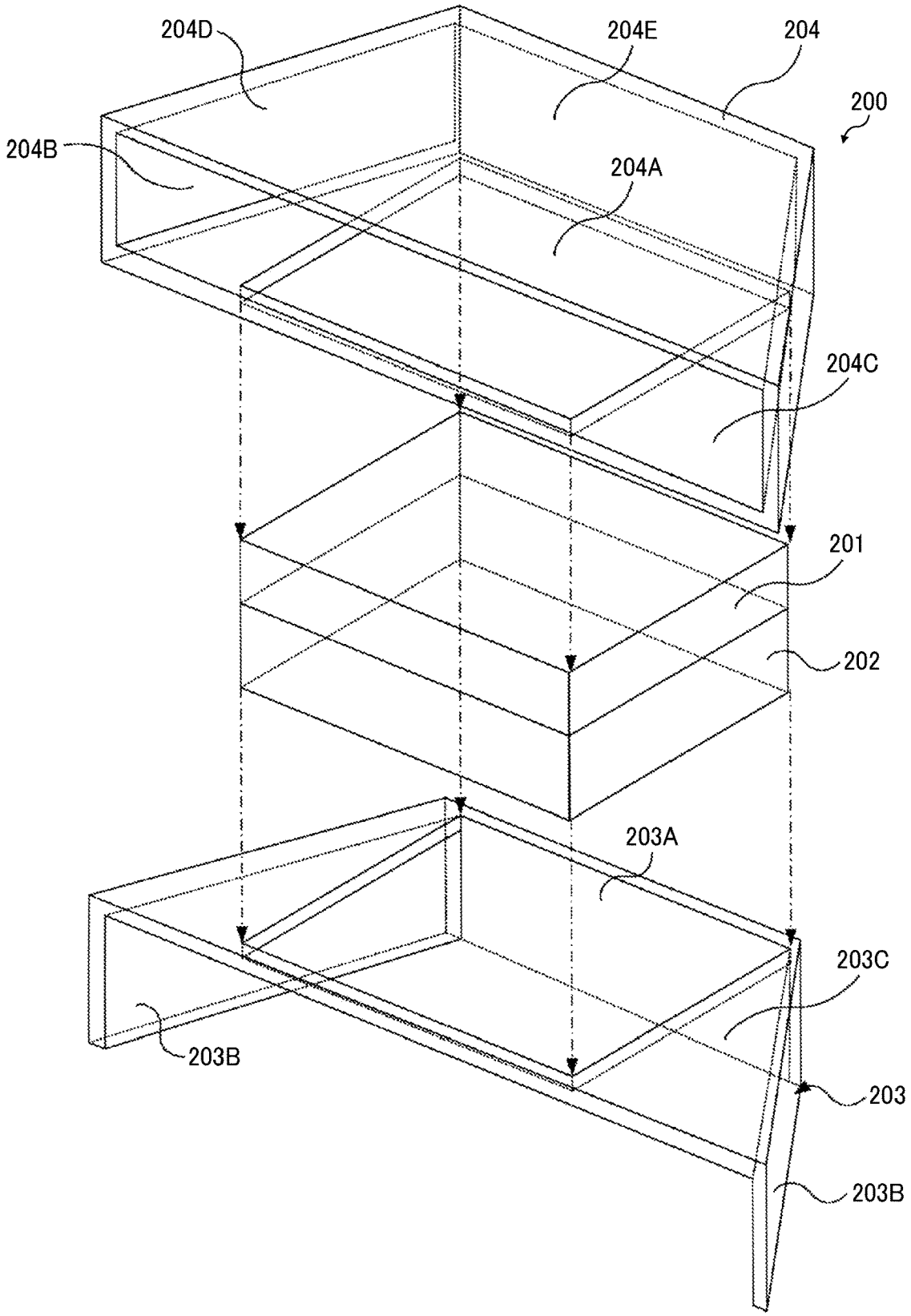
FIG. 8 is an exploded perspective view of an ink mist collector incorporated in the liquid discharge apparatus according to the first embodiment depicted in FIG. 6.

FIG. 8 is an exploded perspective view of the ink mist collector 200. As illustrated in FIG. 8, the ink mist collector 200 includes the suction duct 203, the filter 202, the fan 201, and the exhaust duct 204 that are stacked in this order in the air flow direction D1, that is, an upward direction in FIG. 8.

The suction duct 203 includes air block walls 203B and a top plate 203C. The air block walls 203B define a front side (e.g., an upstream side) and a rear side (e.g., a downstream side) in the air flow direction D1. The front side is open. The air block walls 203B define a gap that decreases from the front side to the rear side. A suction vent 203A serves as a through hole that penetrates through the top plate 203C and communicates with the filter 202.

The front side of the suction duct 203, that is open and defined by the air block walls 203B, faces the head 102.

The filter 202 includes a filter portion disposed inside the filter 202. The filter portion is made of non-woven fabric or the like that is breathable. Air containing ink mist passes through the filter portion upward in FIG. 8.

The fan 201 sends clean air after removal of the ink mist by the filter 202 upward in FIG. 8.

The exhaust duct 204 includes an inlet 204A, an outlet 204B, a bottom plate 204C, side walls 204D, and an air flow adjusting wall 204E. The inlet 204A serves as a through hole that penetrates through the bottom plate 204C and communicates with the fan 201. The outlet 204B exhausts air. The side walls 204D are angled to define a gap therebetween that increases from an upstream position to an air exhaust position in the air flow direction D1 so as to widen an air flow path.

The exhaust duct 204 is oriented such that the outlet 204B faces the encoder 302.

As described above, the liquid discharge apparatus 1 according to the embodiment illustrated in FIG. 6 includes the ink mist collector 200 that is disposed inside the body 14 and separated from the carriage 103. After the clean air not containing the ink mist travels around the encoder 302 and the guide rod 104, reaches the head 102, and passes by the head 102, the filter 202, serving as the ink mist absorber, of the ink mist collector 200 collects ink mist generated by the head 102.

Accordingly, the liquid discharge apparatus 1 advantageously prevents the ink mist from degrading quality of an image formed on a recording medium P and prevents the ink mist from staining the interior of the liquid discharge apparatus 1 more efficiently.

Additionally, the ink mist does not stain the encoder strip 301 and the encoder 302, preventing the controller 801 from controlling the carriage 103 erroneously. The ink mist does not stain the slide face 104*a* of the guide rod 104, preventing increase in friction with which the carriage 103 slides over the guide rod 104 advantageously.

A description is provided of a construction of a liquid discharge apparatus 1S according to a second embodiment of the present disclosure, that incorporates an ink mist collector 200S.

The construction of the liquid discharge apparatus 1S according to the second embodiment is equivalent to the construction of the liquid discharge apparatus 1 according to the first embodiment except for differences in positions of the encoder strip 301 and the encoder 302, respectively, an order in which components of the ink mist collector 200S are stacked, and an air flow direction.

Hence, the following describes the differences between the liquid discharge apparatus 1 according to the first embodiment and the liquid discharge apparatus 1S according to the second embodiment.

Figure 9:
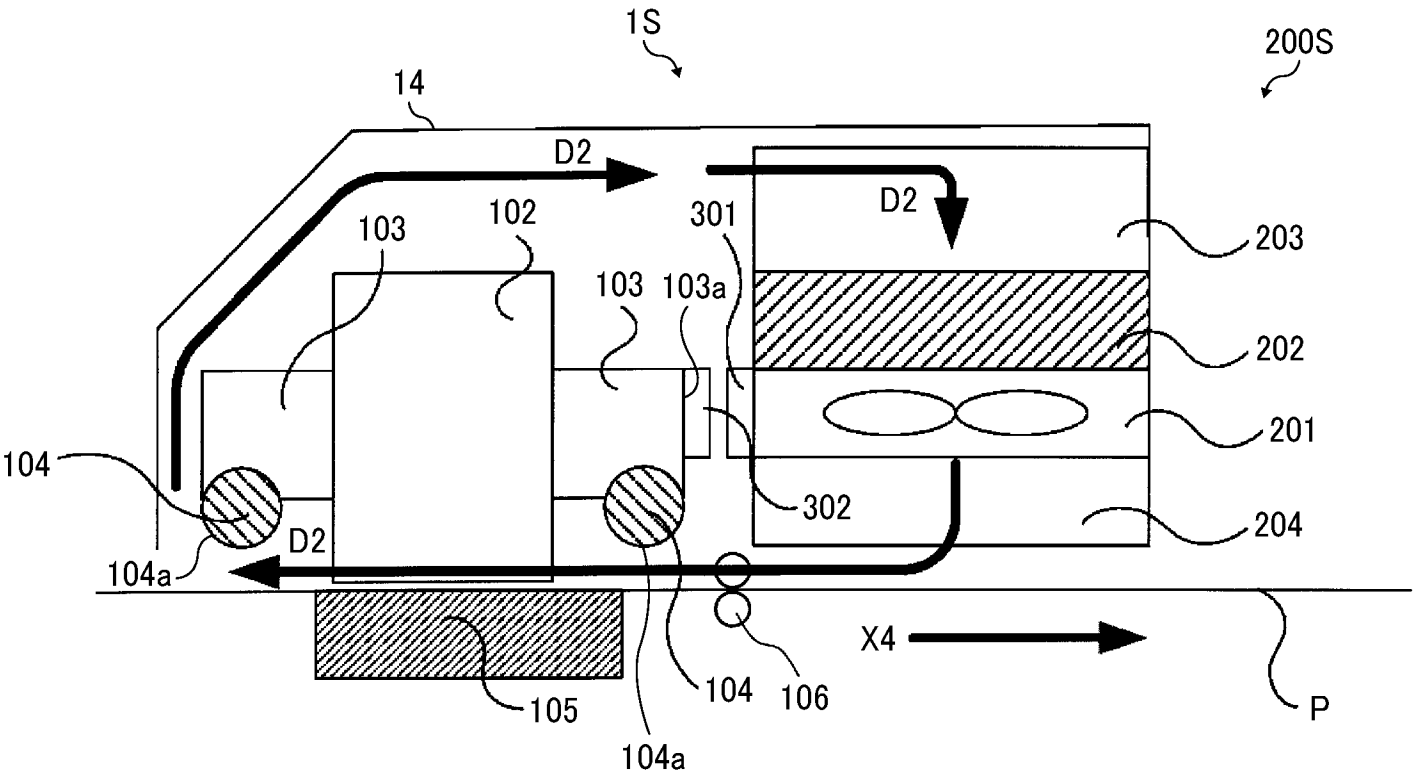
FIG. 9 is a side view of a liquid discharge apparatus according to a second embodiment of the present disclosure, seen from a right side thereof, illustrating a main section of the liquid discharge apparatus.
Figure 10:
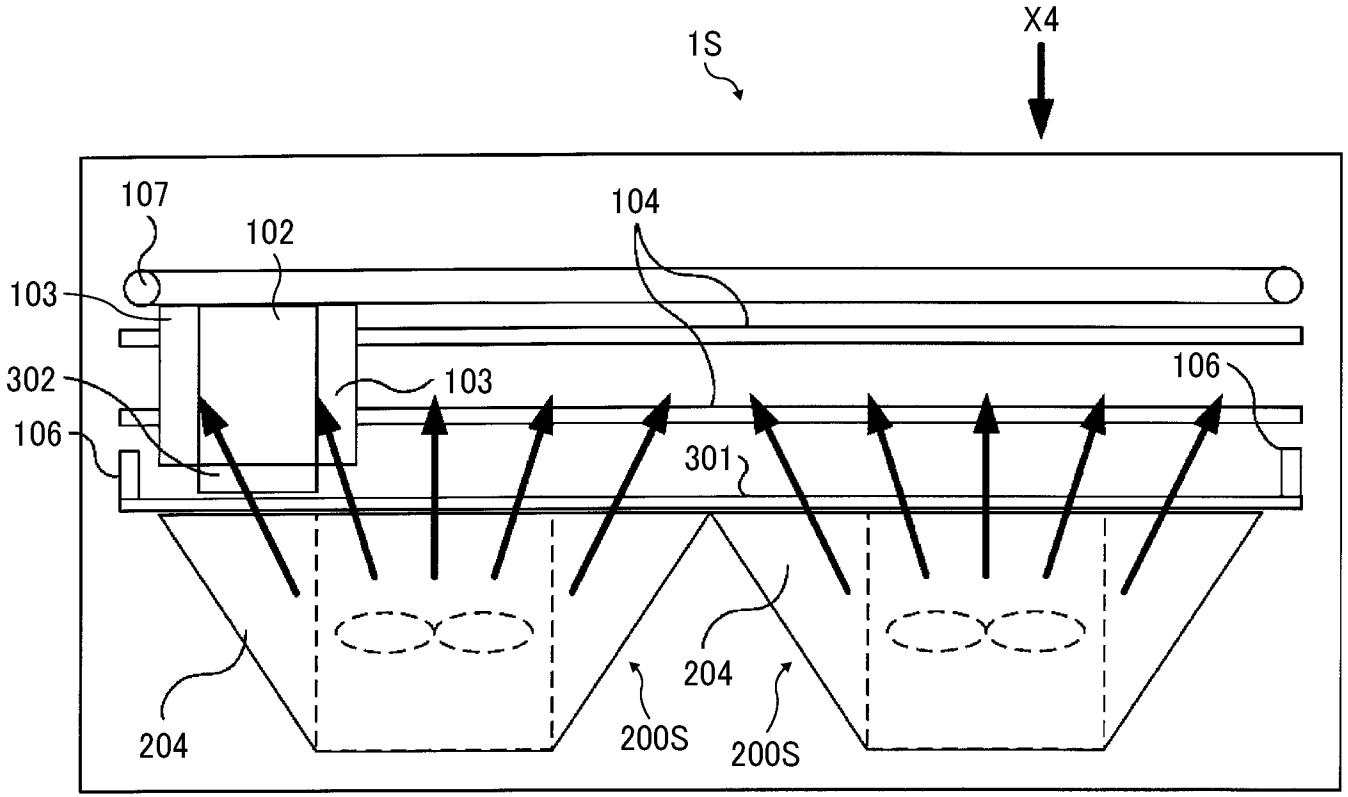
FIG. 10 is a top view of the liquid discharge apparatus according to the second embodiment depicted in FIG. 9, illustrating the main section of the liquid discharge apparatus.

FIG. 9 is a side view of the liquid discharge apparatus 1S seen in the direction X1 in FIG. 1, illustrating a main section of the liquid discharge apparatus 1S seen from a right side thereof. FIG. 10 is a top view of the liquid discharge apparatus 1S seen in the direction X2 in FIG. 1, illustrating the main section of the liquid discharge apparatus 1S seen from above.

As illustrated in FIGS. 9 and 10, the encoder 302 is mounted on a downstream face 103*a* of the carriage 103 in the recording medium conveyance direction X4. The encoder strip 301 is disposed opposite the encoder 302.

As illustrated in FIG. 9, the ink mist collector 200S includes the suction duct 203, the filter 202 serving as the ink mist absorber, the fan 201, and the exhaust duct 204 that are stacked in this order downward in FIG. 9. The fan 201 is disposed downstream from the filter 202 in an air flow direction D2. Accordingly, the filter 202 catches ink mist, preventing the ink mist from staining the fan 201.

As illustrated in FIG. 9 with the air flow direction D2, while air containing ink mist sucked through the suction duct 203 passes through the filter 202, the filter 202 catches the ink mist. The fan 201 sucks clean air not containing the ink mist. The clean air further travels through the exhaust duct 204 and circulates inside the body 14, thus being supplied to an inside of the liquid discharge apparatus 1S.

The clean air travels along an ink outlet face of the head 102, where the ink outlet is disposed, travels below the slide face 104*a* of the guide rod 104, turns along the slide face 104*a* upward, passes above the encoder 302 and the encoder strip 301 with a sufficient distance from the encoder 302 and the encoder strip 301, and reaches the suction duct 203.

Wind pressure of the clean air is sufficiently small with respect to a discharging speed of a main drop discharged from the head 102. Accordingly, flowing of the clean air does not degrade quality of an image formed on a recording medium P.

The wind pressure of the clean air is great enough to collect the ink mist. Accordingly, the suction duct 203 collects the ink mist.

A description is provided of a construction of a liquid discharge apparatus 1T according to a modification example of the liquid discharge apparatus 1S according to the second embodiment.

Figure 11:
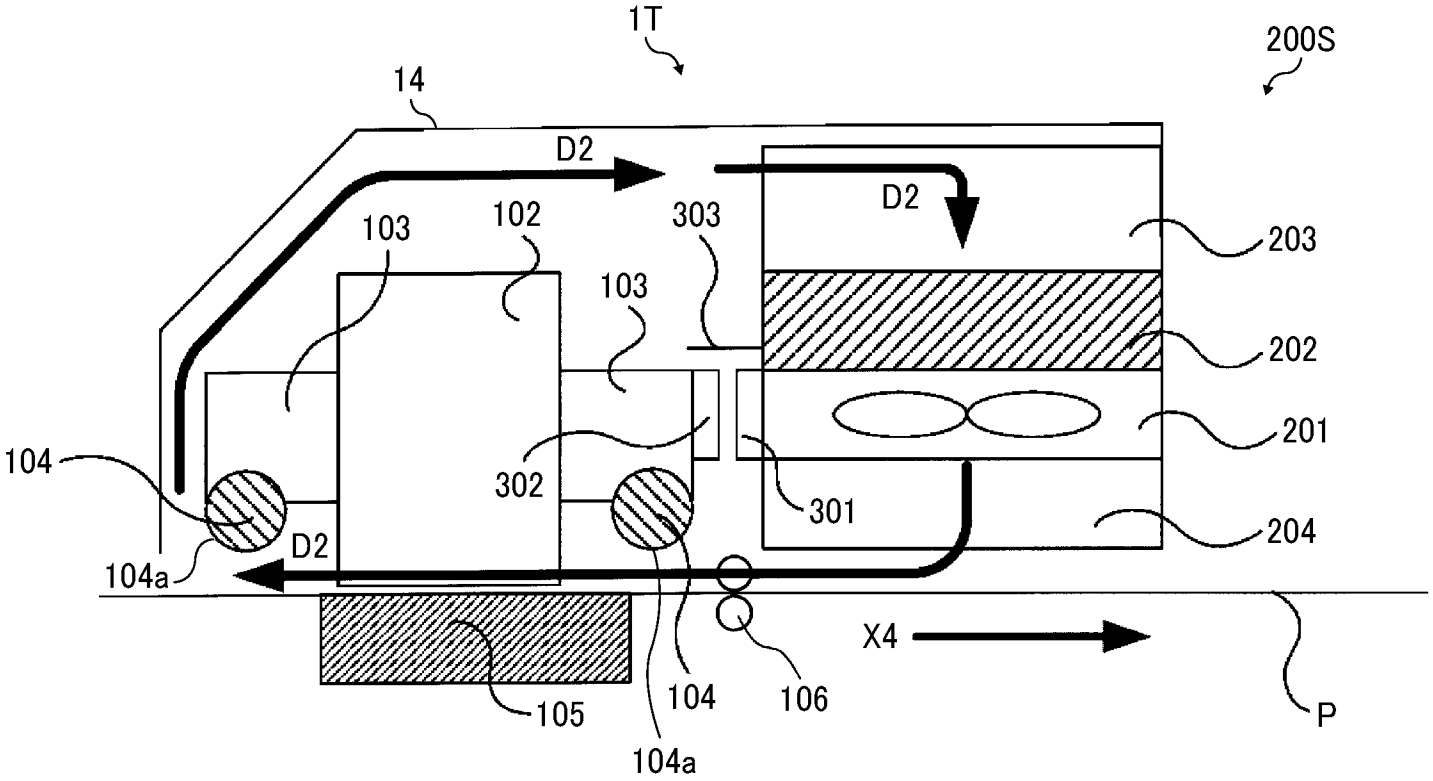
FIG. 11 is a side view of a liquid discharge apparatus according to a modification example of the liquid discharge apparatus according to the second embodiment depicted in FIG. 9, seen from a right side thereof, illustrating a main section of the liquid discharge apparatus.
Figure 12:
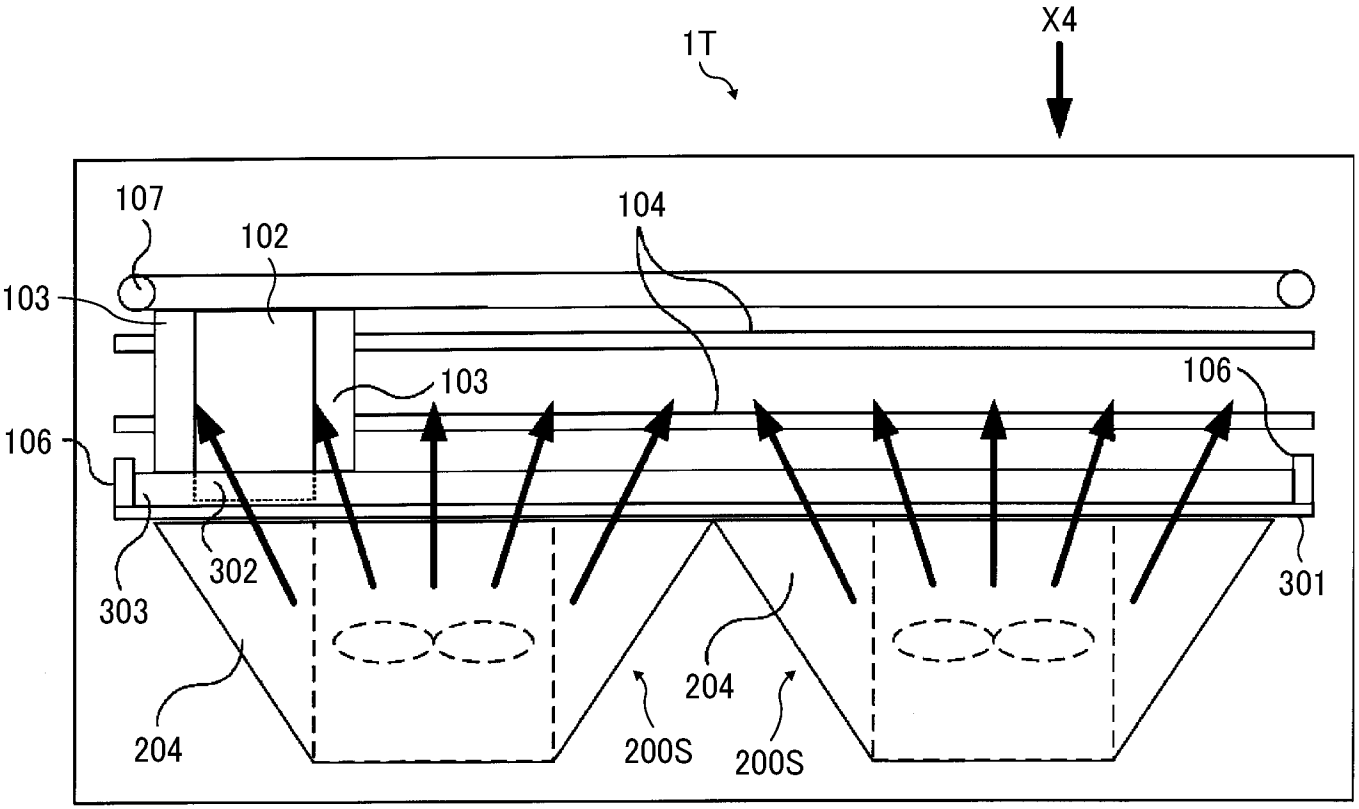
FIG. 12 is a top view of the liquid discharge apparatus according to the modification example of the liquid discharge apparatus according to the second embodiment depicted in FIG. 9, illustrating the main section of the liquid discharge apparatus.

FIG. 11 is a side view of the liquid discharge apparatus 1T seen in the direction X1 in FIG. 1, illustrating a main section of the liquid discharge apparatus 1T seen from a right side thereof. FIG. 12 is a top view of the liquid discharge apparatus 1T seen in the direction X2 in FIG. 1, illustrating the main section of the liquid discharge apparatus 1T seen from above.

As illustrated in FIGS. 11 and 12, the liquid discharge apparatus 1T includes a partition 303 (e.g., a partition wall).

The partition 303 is disposed above the encoder 302. For example, the partition 303 is disposed upstream from the encoder 302 in an air flow direction in which an air current flows toward the encoder 302. The partition 303 prevents the air current from blowing against the encoder 302. For example, the partition 303 is disposed downstream from the head 102 and disposed upstream from the ink mist collector 200S in the air flow direction D2, thus restricting the air current that blows against the encoder 302.

The partition 303 may be a plate that extends in the main scanning direction. For example, the partition 303 is made of metal, resin, cellulose, a compound of those, or the like. However, the material of the partition 303 is not limited.

As described above, the liquid discharge apparatus 1T according to this embodiment includes the ink mist collector 200S that is disposed inside the body 14 and separated from the carriage 103. Clean air, after removal of ink mist, travels below the slide face 104*a* of the guide rod 104 and travels along the ink outlet face of the head 102, where the ink outlet is disposed. Air containing ink mist generated by the head 102 travels below the slide face 104*a* of the guide rod 104, turns along the slide face 104*a* upward, passes above the encoder 302 and the encoder strip 301 with the sufficient distance from the encoder 302 and the encoder strip 301, and reaches the suction duct 203. The filter 202, serving as the ink mist absorber, of the ink mist collector 200S collects the ink mist.

Accordingly, even if the encoder 302 of the liquid discharge apparatus 1T is mounted on a side face of the carriage 103, that is opposite another side face of the carriage 103, that mounts the encoder 302 of the liquid discharge apparatus 1 depicted in FIG. 6, the liquid discharge apparatus 1T advantageously prevents the ink mist from degrading quality of an image formed on a recording medium P and prevents the ink mist from staining an interior of the liquid discharge apparatus 1T more efficiently.

Additionally, the ink mist does not stain the encoder strip 301 and the encoder 302, preventing the controller 801 from controlling the carriage 103 erroneously. The ink mist does not stain the slide face 104*a* of the guide rod 104, preventing increase in friction with which the carriage 103 slides over the guide rod 104 advantageously.

The partition 303 prevents the air current containing the ink mist from blowing against the encoder strip 301 and the encoder 302. Thus, the partition 303 advantageously prevents the ink mist from staining the encoder strip 301 and the encoder 302 more efficiently.

A description is provided of a construction of a liquid discharge apparatus 1U according to a third embodiment of the present disclosure.

The construction of the liquid discharge apparatus 1U according to the third embodiment is equivalent to the construction of the liquid discharge apparatus 1 according to the first embodiment and the construction of the liquid discharge apparatus 1S according to the second embodiment except that the liquid discharge apparatus 1U includes an ink mist absorber that includes a collecting wall 205 mounting ribs 205A disposed upstream from the filter 202 in an air flow direction D3.

Hence, the following describes a construction of the ink mist absorber.

Figure 13:
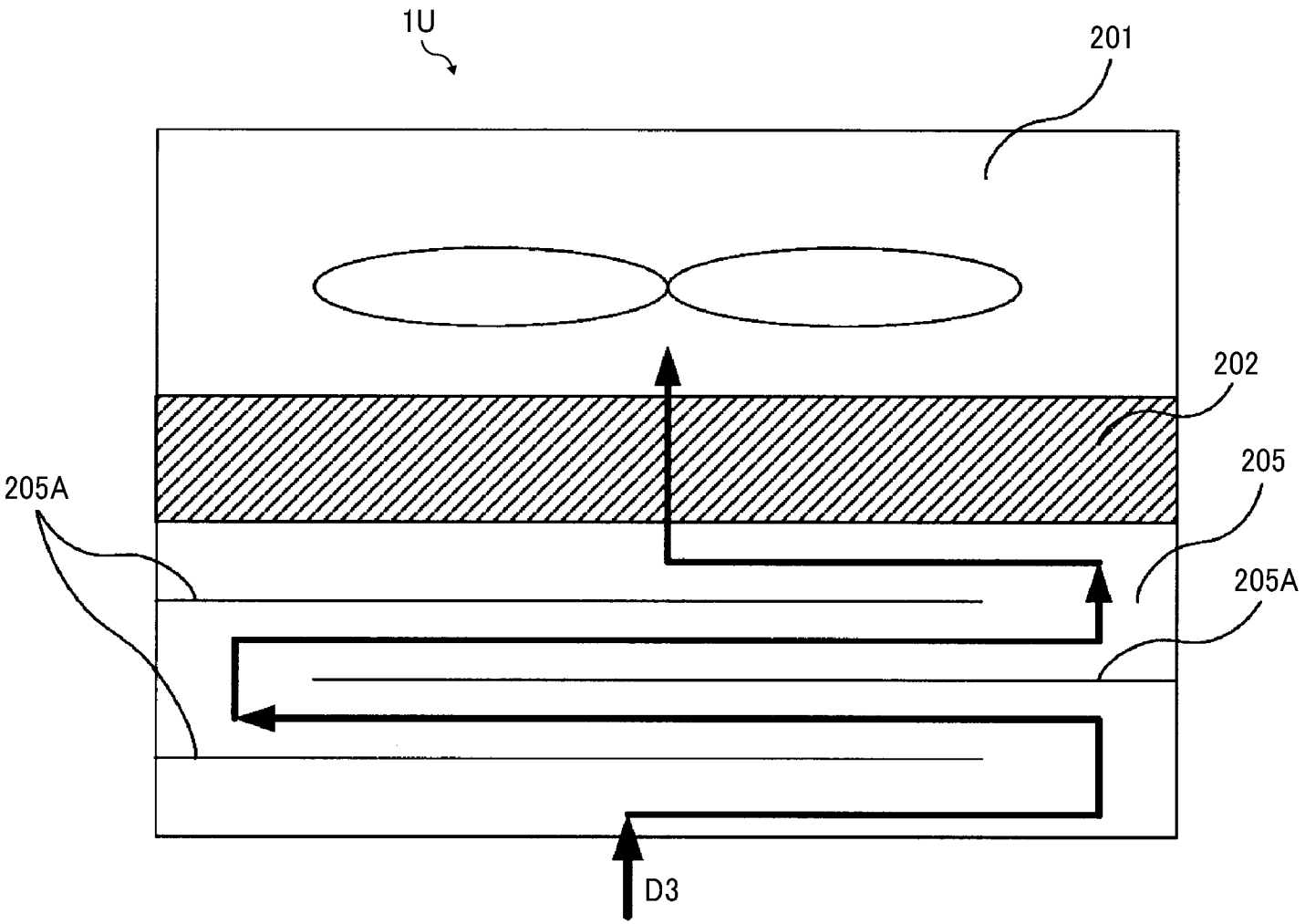
FIG. 13 is a side cross-sectional view of a liquid discharge apparatus according to a third embodiment of the present disclosure, illustrating an ink mist absorber incorporated therein.

FIG. 13 is a side cross-sectional view of the ink mist absorber of the liquid discharge apparatus 1U according to the third embodiment. As illustrated in FIG. 13, the ink mist absorber includes the collecting wall 205 mounting the ribs 205A disposed upstream from the filter 202 in the air flow direction D3.

The rib 205A extends from a first side face, that is, one side face, toward a second side face, that is, another side face, of the collecting wall 205, that is opposite the first side face. The rib 205A does not reach the second side face.

If the collecting wall 205 mounts the plurality of ribs 205A, the ribs 205A are staggered in the air flow direction D3.

When air containing ink mist that passes over the collecting wall 205 blows against the ribs 205A, the ribs 205A attract and collect the air.

As described above, the liquid discharge apparatus 1U according to the third embodiment includes the collecting wall 205 mounting the ribs 205A disposed upstream from the filter 202 in the air flow direction D3.

Accordingly, the liquid discharge apparatus 1U decreases an amount of ink mist that enters the filter 202, advantageously reducing a frequency at which the filter 202 is replaced.

A description is provided of a construction of a liquid discharge apparatus 1V according to a fourth embodiment of the present disclosure.

The construction of the liquid discharge apparatus 1V according to the fourth embodiment is equivalent to the constructions of the liquid discharge apparatuses 1, 1S, 1T, and 1U according to the first to third embodiments, respectively, except that the controller 801 controls an operation of the fan 201.

Hence, the following describes a control of the operation of the fan 201.

FIG. 14 is a block diagram of the liquid discharge apparatus 1V, illustrating the construction thereof. The construction of the liquid discharge apparatus 1V depicted in FIG. 14 is equivalent to the constructions of the liquid discharge apparatuses 1, 1S, 1T, and 1U according to the first to third embodiments, respectively.

As illustrated in FIG. 14, the liquid discharge apparatus 1V includes the controller 801, a memory 802, an input-output device 803, a detector 804, a driver 805, a printing device 806, a fan driver 807, and a communicator 808.

The controller 801 includes an arithmetic logic unit such as a central processing unit (CPU) and controls operations of the liquid discharge apparatus 1V.

The memory 802 includes a storage such as a memory and stores a control program, print data, and the like.

The detector 804 includes sensors such as the home position sensor 804A and the end position sensor 804B.

The driver 805 includes driving devices such as the carriage driver 107 and the 5 conveyor driver 805B that drives the conveyor 106.

A description of the printing device 806 is provided above.

The fan driver 807 controls the operation of the fan 201.

The communicator 808 communicates with an external device (e.g., a client computer).

Figure 15:
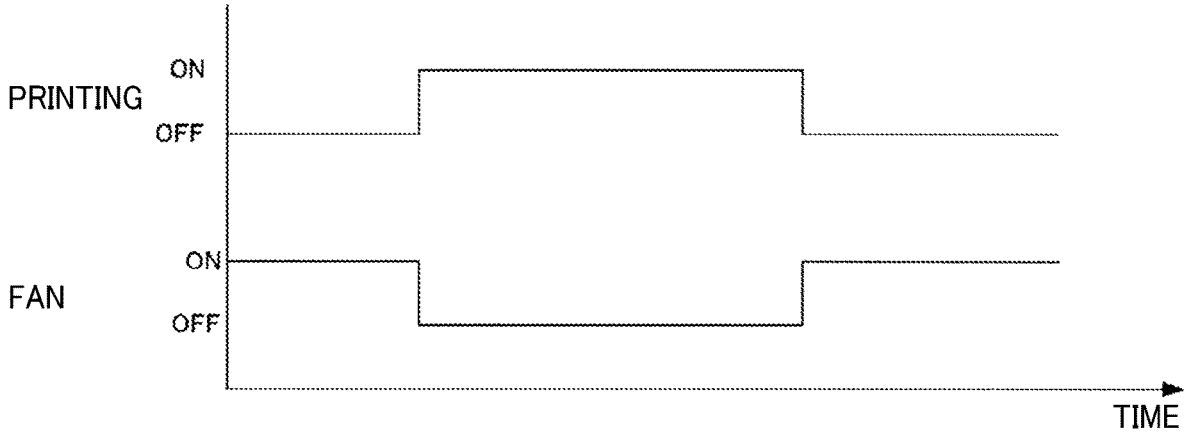
FIG. 15 is a timing chart illustrating a control of an operation of a fan incorporated in the liquid discharge apparatus according to the fourth embodiment depicted in FIG. 14.

FIG. 15 is a timing chart illustrating the control of the operation of the fan 201 incorporated in the liquid discharge apparatus 1V according to the fourth embodiment.

As illustrated in FIG. 15, during a period from starting of printing until finishing of printing, the controller 801 instructs the fan driver 807 to stop the fan 201.

Printing in FIG. 15 denotes a period from a time when the controller 801 receives a print instruction (e.g., print data) from the external device and starts printing until a time when printing according to the print data finishes.

As described above, in the liquid discharge apparatus 1V according to the fourth embodiment, the controller 801 stops the fan 201 during printing.

Accordingly, the liquid discharge apparatus 1V advantageously prevents degradation in quality of an image formed on a recording medium P more effectively and collects ink mist efficiently.

Figure 16:
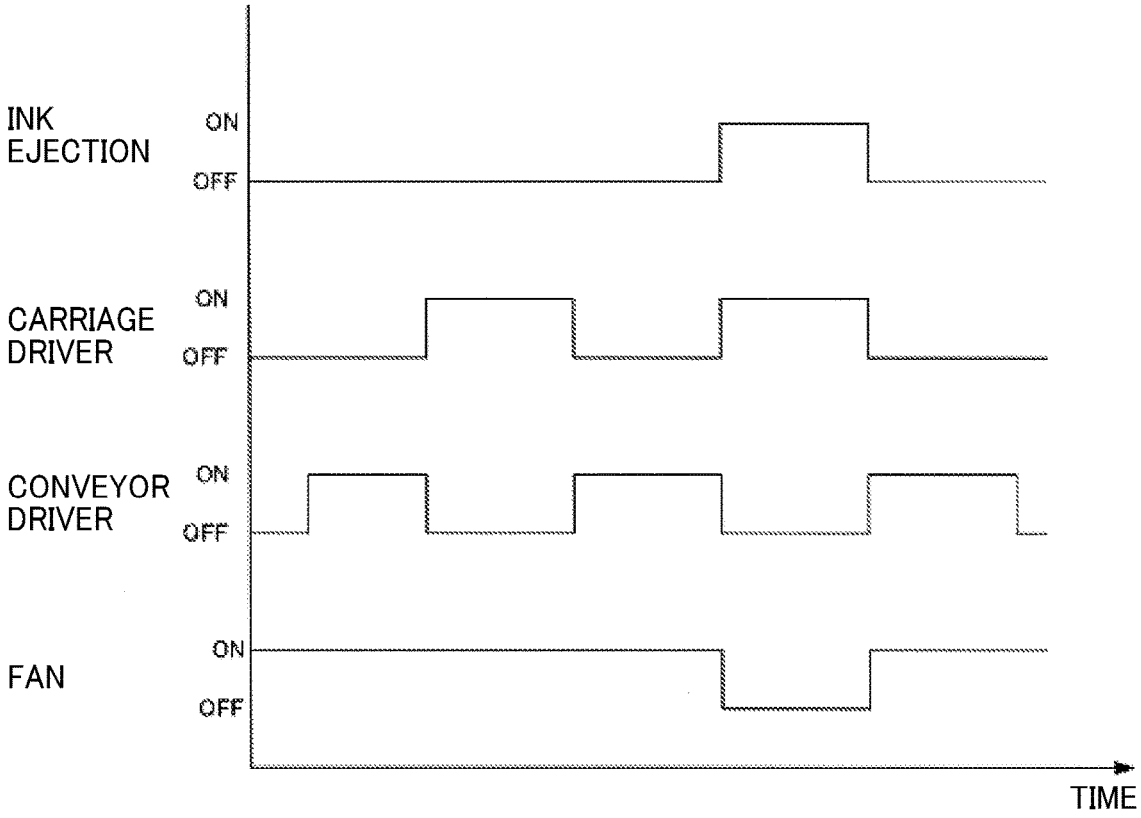
FIG. 16 is a timing chart illustrating a control of an operation, according to a modification example, of the fan incorporated in the liquid discharge apparatus according to the fourth embodiment depicted in FIG. 14.

FIG. 16 is a timing chart illustrating a modification example of the operations of the liquid discharge apparatus 1V according to the fourth embodiment.

As illustrated in FIG. 16, after printing starts, while the head 102 discharges ink, the controller 801 controls the fan driver 807 to stop the fan 201.

As described above, in the liquid discharge apparatus 1V according to the fourth embodiment, the controller 801 stops the fan 201 while the head 102 discharges ink.

Accordingly, the liquid discharge apparatus 1V advantageously prevents degradation in quality of an image formed on a recording medium P and collects ink mist more efficiently.

A description is provided of advantages of a liquid discharge apparatus (e.g., the liquid discharge apparatuses 1, 1S, 1T, 1U, and 1V).

As illustrated in FIGS. 6, 7, 9, 11, 13, and 14, the liquid discharge apparatus includes a body (e.g., the body 14), a carriage (e.g., the carriage 103), a head (e.g., the head 102), an encoder (e.g., the encoder 302), a guide rod (e.g., the guide rod 104), a carriage driver (e.g., the carriage driver 107), a conveyor (e.g., the conveyor 106), and an ink mist collector (e.g., the ink mist collectors 200 and 200S).

The carriage is disposed inside the body and mounts the head that discharges ink onto a recording medium (e.g., the recording medium P) and generates ink mist. The encoder is mounted on the carriage. The guide rod slidably supports the carriage. The carriage driver moves the carriage reciprocatingly in a main scanning direction. The conveyor conveys the recording medium in a sub-scanning direction perpendicular to the main scanning direction. The ink mist collector includes a fan (e.g., the fan 201), a filter (e.g., the filter 202), and a duct (e.g., the suction duct 203 and the exhaust duct 204). The fan generates an air current that circulates in an air flow direction (e.g., the air flow directions D1, D2, and D3) inside the body. The filter collects the ink mist generated by the head. The duct adjusts the air flow direction. The encoder is disposed downstream from the fan and disposed upstream from the head in the air flow direction.

Accordingly, the liquid discharge apparatus prevents the ink mist from degrading quality of an image formed on the recording medium and prevents the ink mist from staining an interior of the liquid discharge apparatus more efficiently.

According to the embodiments described above, each of the liquid discharge apparatuses 1, 1S, 1T, 1U, and 1V is a printer. Alternatively, each of the liquid discharge apparatuses 1, 1S, 1T, 1U, and 1V may be a copier, a facsimile machine, a multifunction peripheral (MFP) having at least two of printing, copying, facsimile, scanning, and plotter functions, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A liquid discharge apparatus comprising:
a body;
a carriage disposed inside the body;
a head mounted on the carriage to discharge ink onto a recording medium and generate ink mist;
an ink mist collector including:
a fan to generate an air current that circulates in an air flow direction inside the body;
a filter to collect the ink mist generated by the head; and
at least one duct to adjust the air flow direction; and
an encoder mounted on the carriage, the encoder disposed downstream from the filter and the fan and disposed upstream from the head in the air flow direction.

2. The liquid discharge apparatus according to claim 1, further comprising a carriage driver to move the carriage reciprocatively in a main scanning direction.

3. The liquid discharge apparatus according to claim 2, further comprising a conveyor to convey the recording medium in a sub-scanning direction perpendicular to the main scanning direction.

4. The liquid discharge apparatus according to claim 3, wherein the encoder is mounted on a downstream face of the carriage in the sub-scanning direction.

5. The liquid discharge apparatus according to claim 1, further comprising an encoder strip disposed opposite the encoder.

6. The liquid discharge apparatus according to claim 5, wherein the ink mist collector is disposed opposite the encoder strip via the carriage.

7. The liquid discharge apparatus according to claim 6, wherein the at least one duct includes:
a suction duct disposed upstream from the filter in the air flow direction; and
an exhaust duct disposed downstream from the fan in the air flow direction.

8. The liquid discharge apparatus according to claim 7, wherein the fan is disposed downstream from the filter in the air flow direction.

9. The liquid discharge apparatus according to claim 1, further comprising a controller configured to control driving of the fan, the controller configured to stop the fan during printing.

10. The liquid discharge apparatus according to claim 9, wherein the controller is configured to stop the fan while the head discharges the ink.

11. The liquid discharge apparatus according to claim 1, further comprising a guide rod to slidably support the carriage, the guide rod including a slide face over which the carriage slides, the slide face disposed upstream from the head in the air flow direction.

12. The liquid discharge apparatus according to claim 1, wherein the ink mist collector further includes:
a collecting wall; and
a rib mounted on the collecting wall and disposed upstream from the filter in the air flow direction.

13. The liquid discharge apparatus according to claim 1, further comprising a partition disposed downstream from the head and disposed upstream from the ink mist collector in the air flow direction, the partition configured to restrict the air current that blows against the encoder.

14. The liquid discharge apparatus according to claim 1, wherein the ink mist collector is separated from the carriage.

* * * * *